United States Patent [19]

Craig

[11] Patent Number: 4,672,827

[45] Date of Patent: Jun. 16, 1987

[54] DISC TUMBLER LOCK WITH REMOVABLE PLUG

[75] Inventor: Clark E. Craig, Simpsonville, S.C.

[73] Assignee: Keycon Hardware Products, Inc., Mauldin, S.C.

[21] Appl. No.: 669,538

[22] Filed: Nov. 8, 1984

[51] Int. Cl.[4] ..... E05B 29/02

[52] U.S. Cl. ..... 70/367; 70/369; 70/377

[58] Field of Search ..... 70/367, 368, 369, 377

[56] References Cited

U.S. PATENT DOCUMENTS

| | | | |
|---|---|---|---|
| 1,805,891 | 5/1931 | Shinn | 70/369 |
| 1,831,118 | 11/1931 | Jacobi | 70/367 |
| 1,979,938 | 11/1934 | Jacobi | 70/367 |
| 2,061,456 | 11/1936 | Falk | 70/369 |
| 2,460,709 | 2/1949 | Navarro | 70/369 |
| 2,647,391 | 8/1953 | Uher | 70/377 |
| 3,263,461 | 8/1966 | Tartagua | 70/377 |
| 3,751,952 | 8/1973 | Rubner | 70/368 |
| 3,774,423 | 11/1973 | Orr | 70/367 |
| 4,398,405 | 8/1983 | Patriquin | 70/369 |
| 4,416,129 | 11/1983 | Thimot | 70/369 |
| 4,440,008 | 4/1984 | Uher | 70/377 |

*Primary Examiner*—Thomas J. Houco
*Assistant Examiner*—Suzanne L. Dino
*Attorney, Agent, or Firm*—Allegretti, Newitt, Witcoff & McAndrews, Ltd.

[57] ABSTRACT

A cylinder lock with a removable plug incorporates a series of spring biased combinating disc tumblers which cooperate with a first key in normal lock operation. An additional, unbiased control tumbler at the end of the plug cooperates with a retention flange associated with the cylinder to retain the plug against removal from the cylinder while permitting rotation of the plug in the cylinder. The control tumbler includes a notch for receipt of the first key as well as a second, plug removal key. The first key acts against one edge of the notch to displace the control tumbler into a position which ensures that the tumbler will remain engaged with the plug retention flange regardless of the orientation of the plug. The second key includes special bitting adapted to engage a separate second edge of the notch associated with the control tumbler to translate the control tumbler such that when the plug is rotated appropriately, the control tumbler is oriented to slide through an axial or longitudinal groove in the cylinder thus permitting removal of the plug from the cylinder.

3 Claims, 15 Drawing Figures

56
14
9
10
15
76
22
94
72
96
54
68
38
54

18
18
18
13

53
59
55
14
16
53
57
52
52
13
15
18
94
63
67
64
65
15
18

DISC TUMBLER LOCK WITH REMOVABLE PLUG

BACKGROUND OF THE INVENTION

This invention relates to an improved cylinder lock construction having a plug which is removable by means of a proper pass key.

It has long been recognized that a cylinder lock having a removable plug is a desirable product. For example, one may remove the plug in order to substitute another plug having a different key bitting arrangement. Alternatively, the plug may need to be removed for repair or replacement. Various prior art patents teach such removable plug constructions including U.S. Pat. No. 4,398,405 issued Aug. 16, 1983 for a "Lock with Key Controlled Removable and Installable Plug and Key for Same" as well as U.S. Pat. No. 4,416,129 issued Nov. 22, 1983 for a "Cylinder Lock with Key Removable Plug". The text of the two patents referenced is incorporated by reference. The patents are believed typical of the prior art relating to the subject matter of the present invention.

With respect to both of the referenced patents, the removable plug includes a series of combinating tumblers in the form of disc tumblers which are spring biased into engagement with the cylinder to thereby lock the plug to the cylinder. The combinating tumblers may be translated to an unlocked position, permitting plug rotation relative to the cylinder, by insertion of a proper key that engages the combinating tumblers and moves them against the spring biasing force. The removable plug also includes, typically, a control tumbler which is responsive to a special control key. The control tumbler is normally spring biased into an annular groove on the inside surface of the cylinder to prevent removal of the plug from the cylinder. The plug may be rotated but not removed. The control tumbler can be released from that groove or slot only when engaged and moved out of the groove by a particular control key. Insertion of the control key thus will move the control tumbler against a spring biasing force acting on that tumbler and effect removal of the tumbler from the groove permitting consequent release of the plug from the associated cylinder.

The prior art teachings perform in a satisfactory manner. However, in the references identified, biasing means such as a spring is utilized to engage the control tumbler. In the event the spring breaks, the plug associated with the cylinder may be accidentally released. Additionally, the use of a spring in association with a control tumbler constitutes an extra part necessary for the operation of the lock.

Against this background, the removable plug lock of the present invention was developed. With the lock of the present invention, a spring associated with the control tumbler has been eliminated thereby eliminating a part, but not the function associated with that part. The present invention also provides additional benefits with respect to the security and operability of the plug removable lock assembly.

SUMMARY OF THE INVENTION

Briefly the present invention of a lock with a removable plug incorporates a series of spring biased, combinating tumblers which cooperate with a first key for normal lock operation. The first key engages the combinating tumblers moving them to a position which enables rotation of the plug within the cylinder associated with the lock. A latch may thus be actuated by rotation of the plug. An additional control tumbler at the rear end of the plug cooperates with a retention flange or circumferential groove associated with the cylinder to retain the plug in the cylinder. The control tumbler comprises a disc having a notch for receipt of the first key or a second, plug removal key. The first key acts against one edge of the notch to displace the control tumbler into a position which ensures that the tumbler will remain engaged with the retention flange regardless of the orientation of the plug. The second key includes special bitting adapted to engage a separate, second edge of the notch of the control tumbler to translate the control tumbler into a position where, when the plug is rotated appropriately, the control tumbler is oriented to slide through a longitudinal groove on the inside surface of the cylinder thus permitting removal of the plug from the cylinder. In sum, distinct edges of the notch associated with the control disc tumbler are engagable by separate keys depending upon whether the plug is to be removed or not. The necessity for a spring to bias the control tumbler is eliminated. Additionally, the control tumbler is appropriately sized and shaped to ensure that the plug is maintained within the cylinder at all times except when the appropriate control key is inserted into the plug and the plug is oriented properly with respect to an axial or longitudinal groove in the cylinder.

Thus, it is an object of the invention to provide an improved rotatable plug, cylinder lock having a removable plug responsive to a special control key.

Still a further object of the invention is to provide a removable, rotatable plug cylinder lock having fewer parts while maintaining substantially all the characteristics and functions associated with prior art locks of the same general kind.

Still another object of the invention is to provide an improved rotatable, removable plug utilizing a series of spring biased combinating tumblers to cooperate with an operating key and utilizing an additional unbiased control disc tumbler cooperative with a plug removal key and the operating key.

Still another object of the invention is to provide an improved plug removal assembly for a cylinder lock which is easy to manufacture, repair and replace.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
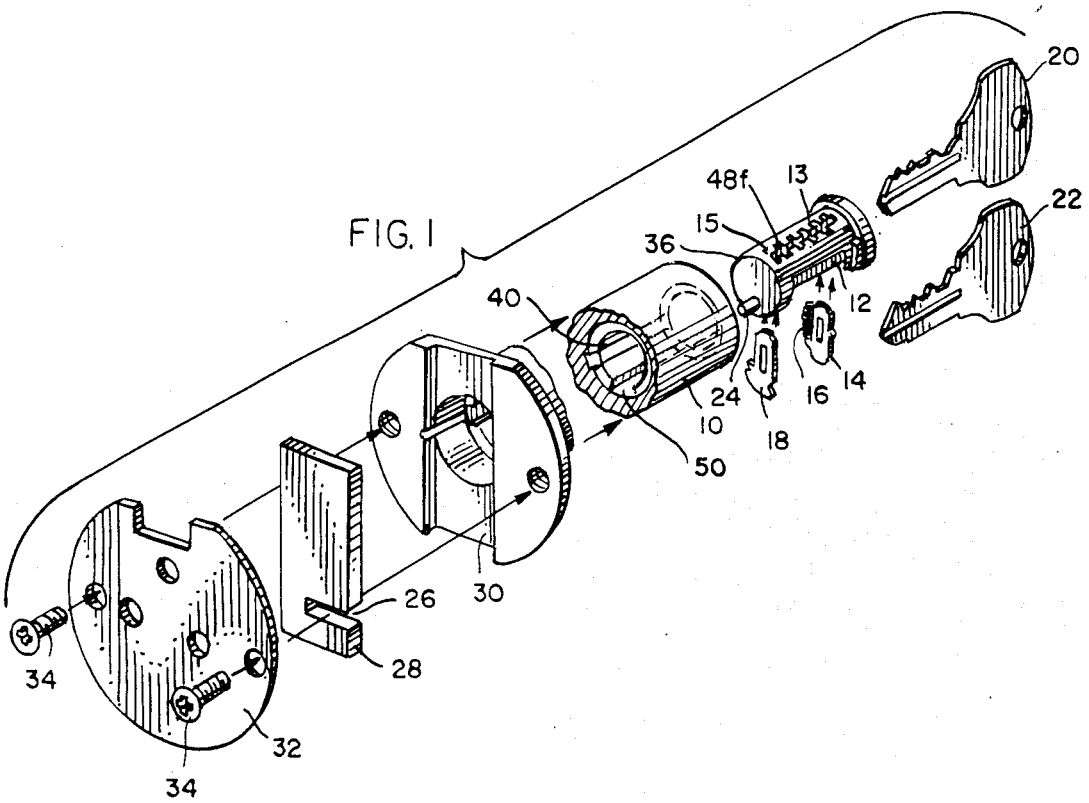
FIG. 1 is an exploded perspective view of the improved cylinder lock of the present invention.

FIG. 1 is an exploded perspective view of the improved cylinder lock of the present invention. The cylinder lock includes a cylinder, shell or housing 10 which is adapted to receive a plug 12. The plug 12 includes transverse slots 48 to receive, by way of example, a set of five combinating, disc tumblers 14*a–e* which are biased by springs 16*a–e*. The number of combinating tumblers is not a limitation of the invention. A control tumbler 18 is also received by the plug 12; however, the control tumbler 18 is not spring biased, but rather floats freely in a transverse slot 48*f* in the plug 12. The tumblers 14*a–e* and 18 are responsive to both a first normal operating key 20 and a second or change key 22. Either one of the keys 20 or 22 may be inserted into an appropriate key slot 46 in FIG. 4 in the plug 12 in order to move tumblers 14*a–e* to the unlocked position thereby permitting rotation of the plug 12 within the cylinder 10.

The plug 12 includes a projecting stub 24 which acts as a drive stud or drive pin that cooperatively engages in a longitudinal slot 26 in a latch bar 28. Latch bar 28 is slidably positioned in a channel 30 at the end of the cylinder 10. A keeper plate 32 retained by fasteners 34, for example, or by staking, holds the latch bar 28 in the channel 30 so that it will remain in proper engagement with the stud or drive pin 24. Thus, as the plug 12 is rotated by manipulation of key 21 or 22, the latch bar 28 will move in the channel 30 between a latched or locked position and an unlatched or unlocked position.

The subject matter of the present invention relates to a particular configuration and construction of the tumblers 14*a–e* and 18 as well as the keys 20 and 22 in combination with the plug 12 and the interior construction of the cylinder 10. The particular construction to be described permits rotation of the plug 12 by the first key 20 in the normal manner of a lock which is operated by a key. Using the second or change key 22, it is possible to move the control tumbler 18 within the plug 12 to a position that will enable the plug 12 to be rotated and then removed from the cylinder 10. Then a new plug 12 having a different combination can be replaced in the cylinder 10 or, alternatively, the removed plug 12 can be repaired for subsequent reinsertion into the cylinder 10.

The invention relates to the specific construction of the keys 20, 22, the plug 12, and the cylinder 10 so as to enable removal of the plug 12 from the cylinder 10 by use of the special, change key 22. FIG. 2–15 illustrate in greater detail the specific internal construction of these described components and how they are used in order to effect removal of the plug 12.

Figure 2:
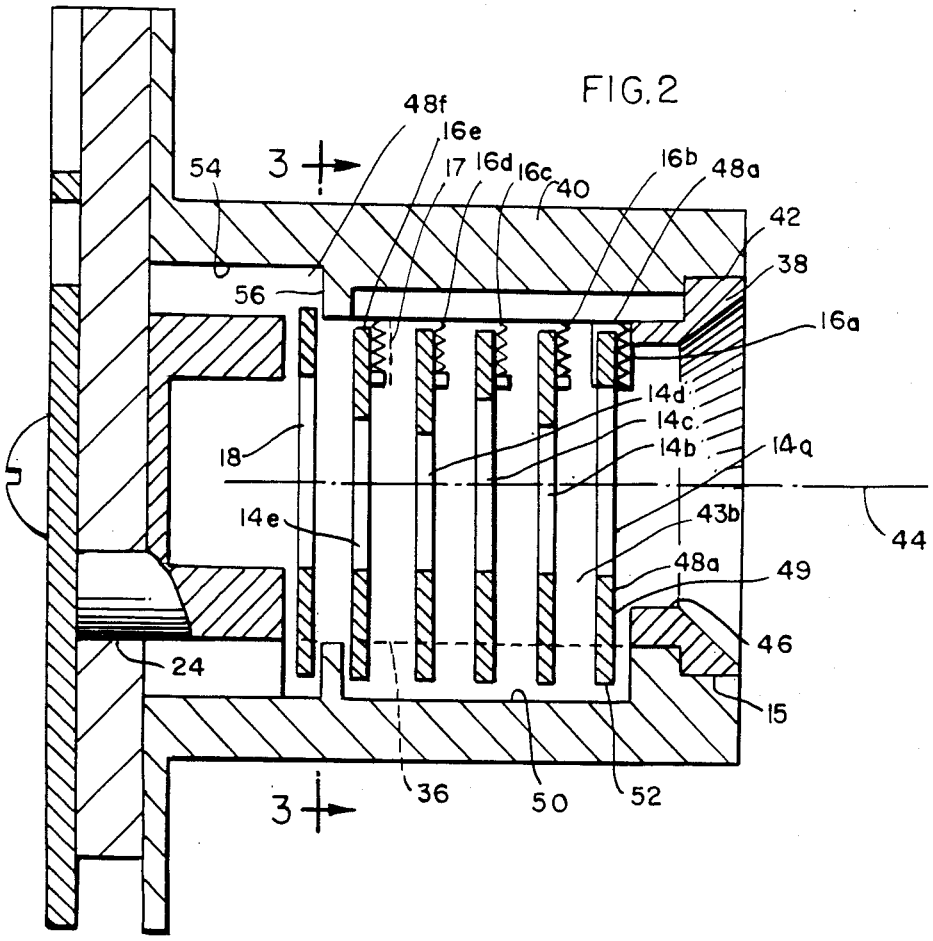
FIG. 2 is a side, cross sectional view of the plug and cylinder for the lock shown in FIG. 1 prior to the insertion of any key into the plug.
Figure 3:
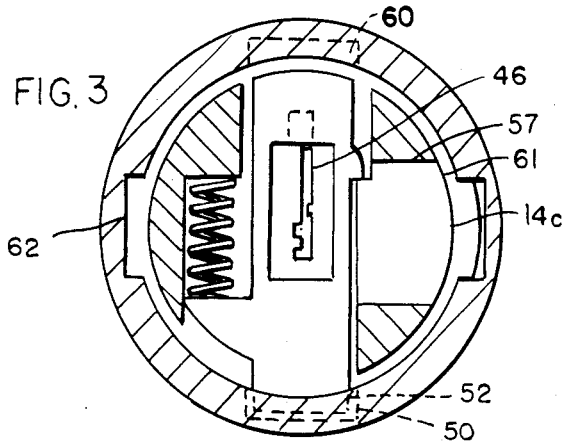
FIG. 3 is an end cross sectional view taken substantially along the line 3—3 in FIG. 2.

FIGS. 2 and 3 illustrate the internal cross sectional configuration of plug 12 when the plug 12 is positioned within the cylinder 10 and no key is inserted into the plug 12. The plug 12 has a generally constant diameter barrel 36 with a larger diameter, integral face plate 38 defining a flange to retain the plug 12 in the cylinder 10. The cylinder 10 has an internal bore 40 having a diameter slightly greater than that of the barrel 36 in order that the barrel 36 of the plug 12 may be rotatably received in the bore 40. The cylinder 10 also includes a counterbore 42 on its front face for receipt of the face plate 38 to limit translation of the plug 12 into the cylinder or housing 10.

Figure 5:
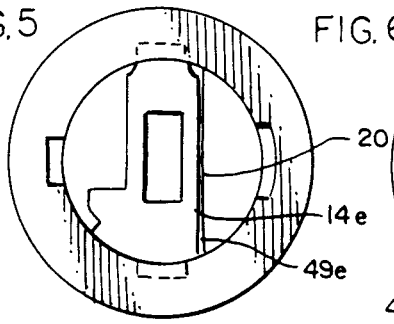
FIG. 5 is a cross sectional view taken substantially along the line 5—5 in FIG. 4.

The plug 12 defines a center line axis 44. A key slot 46 for receipt of either of the keys 20 or 22 extends along the axis 44 and intersects a series of six transverse slots or passages 48*a–48f* which extend through the plug 12 generally transverse to the axis 44. The passages 48*a–f* are for receipt of tumblers 14*a–e* and 18 in serial order. Thus, passages 48*a–e* receive combinating tumblers 14*a–e*. Passage 48*f* receives the control tumbler 18. The passages 48*a–f* are all generally of the same size and shape and are equally spaced from one another. In the embodiment shown, the passages 48*a–f* are generally a rectangular shaped slot passing entirely through the plug 12 with the bottom section 49 of each slot 48*a–f* having a greater transverse dimension as depicted in FIG. 5.

As previously described, combinating disc tumblers 14*a–e* are positioned within the passages 48*a–e*. Each of the combinating tumblers 14*a–e* are biased by an associated spring 16*a–e* in a uniform direction so that the tumblers 14*a–e* will project into the longitudinal key slot 46 in plug 12. Also, the tumblers 14*a–e* are biased into a longitudinal groove 50 defined on the inside surface of the bore 40 at what will be termed the six o'clock or 180° position as viewed in FIG. 3. Thus, the combinating tumblers 14*a–e* are sized and shaped at their lower end or locking end to define a lobe 52 which cooperates and fits into the groove 50 (see FIG. 12). Note lobe 52 has a lateral dimension slightly less than the width of groove 50 and substantially equal to the lateral dimension of the main body 53 of tumbler 14.

Importantly, the groove 50 does not extend for the full length of the bore 40. Rather, it extends to a position between the fifth tumbler 14*e* and the control tumbler 18 as shown in FIG. 3. The bore 40 connects with an enlarged diameter bore 54 to define a flange or outwardly extending flange surface 56. This flange 56 is important for its function of retaining the plug 12 in position within the cylinder 10 as will be explained. The flange 56 is positioned slightly forward of the front face of the control tumbler 18 when the plug 12 is in position. Thus, flange 56 is intermediate tumbler 14*e* and tumbler 18.

The control tumbler 18 (FIGS. 14 and 15) has a height which is greater than the diameter of the bore 40 of the plug 12. This is contrasted with the combinating tumbler 14 which has a height equal to or less than the diameter of bore 40. Thus, because of its height dimension, the control tumbler 18 always engages against the flange 56 regardless of the orientation of the tumbler 18 with respect to the flange 56 except for the one specific situation to be described. That is, referring to FIG. 2, if the plug 12 is in the orientation depicted, gravity will cause the control tumbler 18 to drop to the position indicated so that the tumbler 18 is against the flange 56. If for some reason the orientation of the plug 12 is altered and the tumbler 18 is caused to slide in its associated passage 48*e*, the tumbler 18 will move through slot 48*e* and project from the opposite side of slot 48*e*. Thus, tumbler 18 will still remain in contact with the flange 56 and will prevent removal of plug 12 from bore 40. Note that in the condition depicted in FIG. 2, the plug 12 is not rotatable since the remaining combinating tumblers 14*a–e* engage groove 50 and prevent rotation. Thus, regardless of the physical orientation of the cylinder lock as depicted in FIG. 2, the control tumbler 18 will always remain contacting the flange 56 preventing removal of the plug 12 from the cylinder 10.

Figures 8, 9, 10, 11, 12, 13, 14, 15:
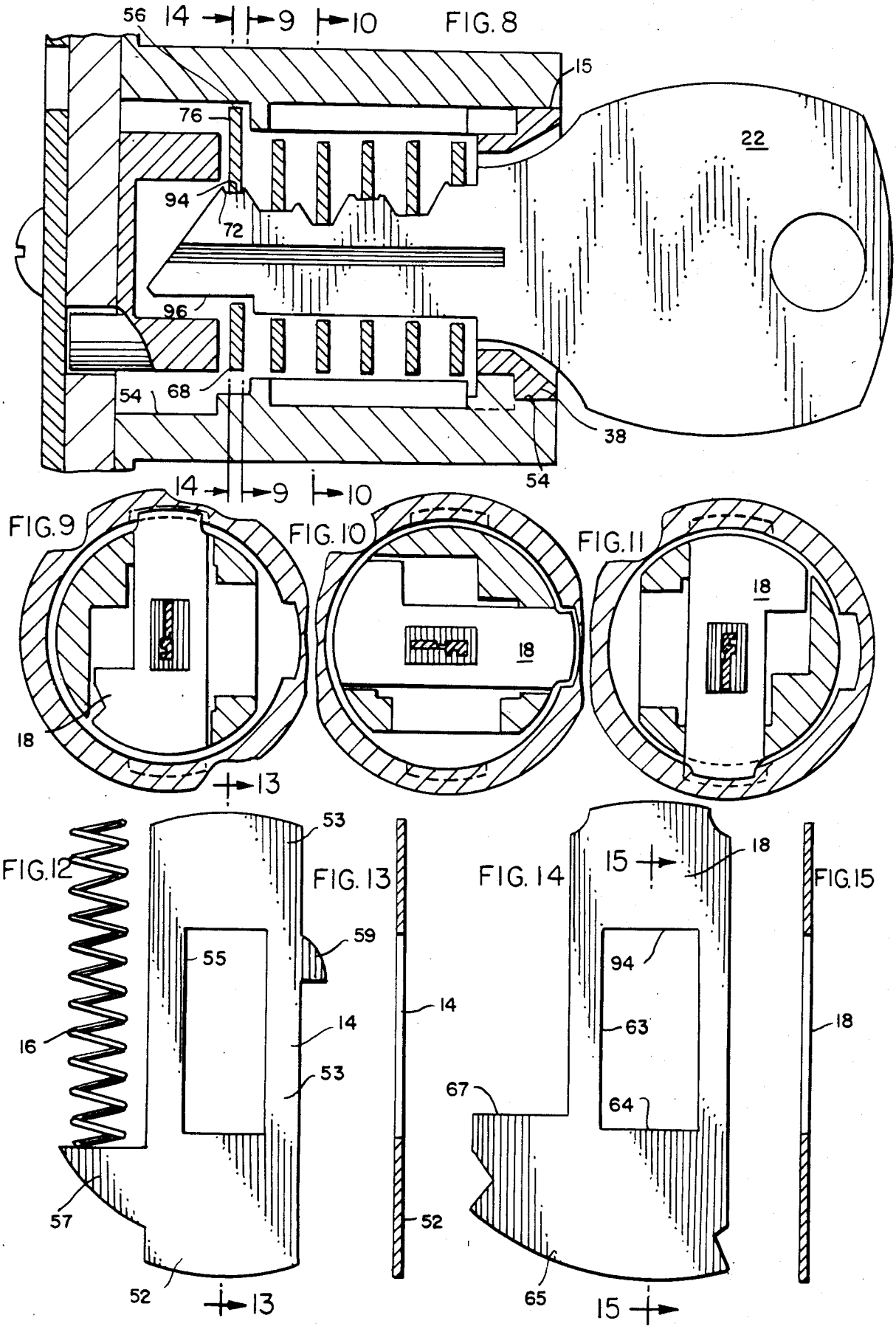
FIG. 8 is a side cross sectional view similar to FIG. 2 wherein a special plug removal, change key or the second key has been inserted into the plug.
FIG. 9 is a vertical cross sectional view of FIG. 8 taken substantially along the line 9—9.
FIG. 10 is a cross sectional view similar to FIG. 9 wherein the key and associated plug have been rotated 90° clockwise as viewed from the key insertion end.
FIG. 11 is a view similar to FIG. 10 wherein the plug and key have been rotated 180° clockwise.
FIG. 12 is a plan view of a combinating tumbler.
FIG. 13 is a cross sectional view of the combinating tumbler taken substantially along the line 13—13 in FIG. 8.
FIG. 14 is a plan view of a control tumbler.
FIG. 15 is a vertical cross section of the control tumbler of FIG. 14 taken substantially along the line 15—15 in FIG. 14.

Before proceeding with further discussion of the operation of the lock, reference is made to FIGS. 12 and 13 which depict the specific structure of the combinating tumblers 14*a–e*. Referring first to FIG. 12, each combinating tumbler 14*a–e* is fabricated from a wafer of metallic material. It includes a main body section 53 having a lateral dimension substantially equal to the lateral dimension of the associated slot 48 in the plug 12. Each tumbler 14 also includes a notch 55 extending therethrough for receipt of a key and more particularly bitting associated with a key. A projecting wing 57 extends from the side of tumbler 14 for cooperation with spring 16 which fits within a spring passage 17 defined in the plug 12 so as to bias the combinating tumblers 14. The tumbler 14 also includes the lower projecting lobe 52 having a width equal to or less than the width of cylinder grooves 50 and 60. Opposite wing 57, a tab or tang 59 projects from the side of the tumbler 14 for engaging a land 61 in FIG. 3 associated with plug 12 to limit the biased travel of the combinating tumbler 14. The position of the notch 55 in the tumbler 14 is associated with the depth of associated bitting on the key 20 or 22.

Referring to FIG. 14, the control tumbler 18 has a height dimension which is greater than the diameter of the bore 40 as previously described. The control tumbler 18 also includes a notch 63 again for receipt of a key. The notch has a lower edge 64 and an upper edge 94 for cooperation with keys 20, 22 as will be described. The control tumbler 18 also includes a lower lobe 65 which has a lateral dimension or width greater than any of the grooves 50, 60, or 62. Additionally, the control tumbler 18 includes a ledge 67 which prevents the tumbler 18 from sliding totally through the associated slot in the plug 12.

Referring again to FIG. 3, the longitudinal groove 50 is at the six o'clock or 180° position and is complemented by another longitudinal groove 60 at the twelve o'clock or 0° position. Both grooves 50 and 60 are cut in the inside wall of the cylinder 10 to a position between the last combinating tumbler 14e and the control tumbler 18. Grooves 50 and 60 do not extend through flange 56. Plug removal groove 62, however, extends the total distance of the bore 40 through flange 56. The groove 62 is at the nine o'clock or 90° position as depicted in FIG. 3. The groove 62 is more shallow than the grooves 50 or 60. All grooves 50, 60 and 62 are parallel to longitudinal axis 44.

Figure 4:
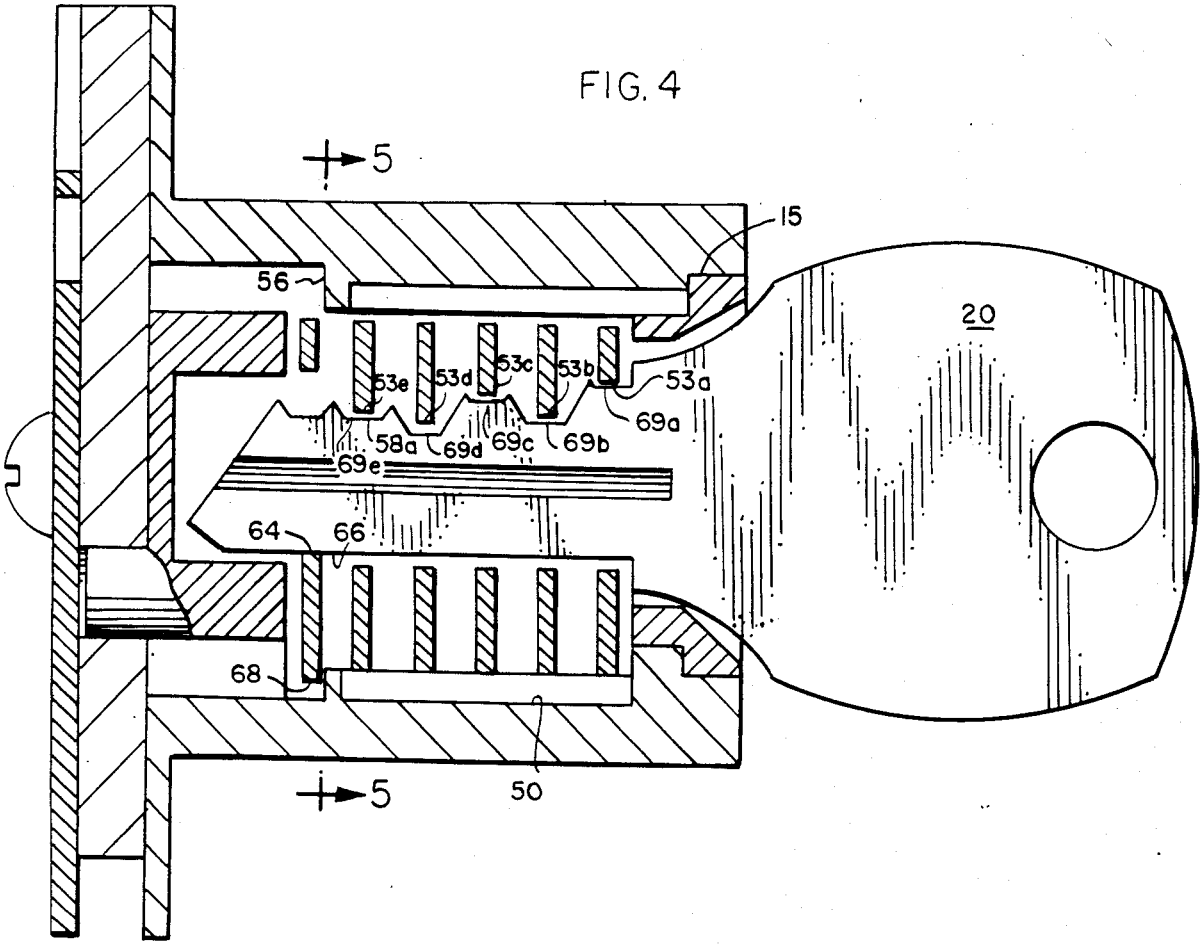
FIG. 4 is a side cross sectional view of the plug and cylinder similar to that shown in FIG. 2 wherein an operating or first key has been inserted into the plug.

FIG. 4 illustrates operation by the first or operating key 20 inserted into the cylinder lock of the present invention. Referring to FIG. 4, the key 20 is inserted into the key slot 46 and engages combinating tumblers 14*a–e* as well as the control tumbler 18 by extending through notches 55*a–e* and 63. Thus, associated bitting 69*a–e* on the key 20 engages the top or first edge 58*a–e* of the resepective notch 55*a–e* of combinating tumblers 14*a–e* to drive those tumblers 14*a–e* upward as depicted in FIG. 4 out of the groove 50. The plug 12 may then be rotated. The control tumbler 18, however, includes a first edge 64 in notch 63 which is engaged by the bottom surface 66 of the key 20. Because of the spacing arrangement and sizing of the slot 63 and edge 64 with respect to the bottom 68 of the control tumbler 18, the key 20 effectively forces the control tumbler 18 into a position where that tumbler 18 can engage the flange 56. Since the lobe 65 or bottom edge 68 of the control tumbler 18 has a width which is greater than the width of the grooves 50, 60 and 62, even if the plug 12 is rotated by the key 20 so as to align the control tumbler 18 with the groove 62, the plug 12 cannot be removed from the cylinder 10. In actual practice, stops may be built in either the integral front face plate 38 or front flange of plug 12 or in the enlarged diameter bore 54 to limit the direction and degree of rotation of the plug 12 in the cylinder 10.

Figure 6:
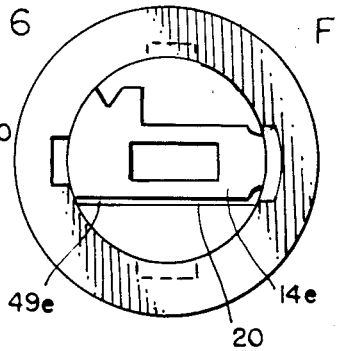
FIG. 6 is a vertical cross section of the lock shown in FIG. 4 wherein the plug has been rotated 90° clockwise as viewed from the key insertion end of the plug.
Figure 7:
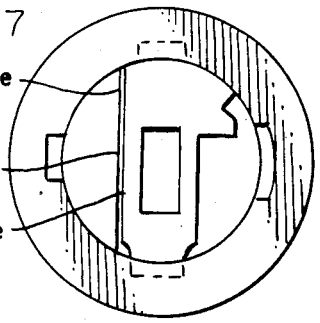
FIG. 7 is a view similar to FIG. 6 wherein the key has been rotated 180°.

FIG. 5 is a cross-sectional view of the plug 12 in the cylinder 10 when the key 20 is being used and is positioned as shown in FIG. 4. FIG. 6 illustrates a 90° rotation of the plug 12 of FIG. 4 in the cylinder 10 so as to align the edge 68 of tumbler 18 over the groove 62. FIG. 7 illustrates a 180° rotation of the plug 12. When in this position, the key 20 may be removed and the tumblers 14*a–e* will then be biased into engagement with the groove 60, as illustrated, to lock the plug 12 against rotation.

FIG. 8 illustrates the use of the change key or second key 22. Again, the starting point is the plug 12 and cylinder 10 arrangement of FIG. 2. The change key 22 is then inserted to drive the combinating tumblers 14*a–e* in the same manner as previously described. However, in this instance, the key 22 includes a special forward bitting 72 which engages the opposite edge or second edge 94 of the notch 63 associated with the control tumbler 18 to drive that tumbler 18 in a direction which is opposite from the direction shown in FIG. 4. When driven in this opposite direction, the tumbler 18 becomes aligned as depicted in FIG. 8 so that the lower edge or lobes 52, 65 of all of the combinating tumblers 14*a–e* and control tumbler 18 are aligned on the diameter of the bore 40. The key 22 may then be rotated 90° clockwise as depicted in FIG. 10 so as to align the top edge 76 of the control tumbler 18 with the groove 62. The width of the top edge 76 of the control tumbler 18 is substantially identical to or slightly less than the width of the groove 62. The top edge 76 projects beyond the diameter of the bore 40 but not beyond the depth of groove 62. Thus, the tumbler 18 can slide in the groove 62 permitting removal of the plug 12 from cylinder 10.

FIG. 11 illustrates a rotation of 180° of the lock depicted in FIG. 8. It is to be noted that in the arrangement of the lock depicted in FIG. 11, the plug 12 is oriented so that it cannot be removed from the cylinder 10. Only when the plug 12 is oriented in the cylinder 10 as shown in FIG. 10 can the plug 12 be removed from the cylinder 10 provided, of course, the change key 22 is being utilized to properly position tumbler 18. Importantly, the change key 22 cooperates with the second edge 94 associated with the control tumbler 18. Moreover, the change key 22 includes a cut out section or notch 96 which permits translation of the control tumbler 18 in the passage 48*e* a sufficient distance so that the control tumbler 18 and more particularly the bottom edge 68 will align with the bore 40 of the plug 12.

With the lock of the present invention, it thus possible to eliminate any biasing means associated with a control tumbler that retains a plug within a cylinder. Nonetheless, removal of the plug from the cylinder when the proper change key is inserted into the plug is still possible. Again, it is noted that the height of the control tumbler 18 is greater than the diameter associated with the bore 40. By contrast, the height of the combinating tumblers 14*a–e* is about equal to or less than the diameter of the bore 40. By this combination of features, it is possible to permit rotation of the plug 12 by operation of the combinating tumblers 14. The control tumbler 18 is then utilized for cooperation with the flange 56 in order to permit longitudinal or to prevent longitudinal movement of the plug 12 in the cylinder 10 as the case may be.

Various alterations and changes to the described construction are deemed to be within the scope of the invention. For example, the combinating tumblers may be pin tumblers. Thus, while there has been set forth a preferred embodiment of the invention, it is to be understood that the invention is to be limited only by the following claims and their equivalents.

What is claimed is:

1. A cylinder lock with a key operated removable plug comprising, in combination:

a first key means for operating the cylinder lock;

a second key means for allowing removal of the plug;

a cylinder having a longitudinal axis and defining a cylindrical passage of substantially constant diameter;

an outwardly extending circumferential flange at one end of the passage, a longitudinal groove in the inside surface of the passage through the flange to the front end of the passage;

a plug rotatable mounted for rotation about the longitudinal axis in the cylinder passage, said plug having an outside diameter substantially equal to the diameter of the cylinder passage and rotatably mounted in the cylinder passage, said plug including front face plate means of greater diameter than the plug to limit translation of the plug in the cylinder from the front of the passage, said plug including a plurality of tumbler passages generally transverse to the longitudinal axis, an associated key slot mateable with the first and second key means and interconnecting the tumbler passages, and a control tumbler passage mateable with the first and second key means, said control tumbler passage positioned at least in part longitudinally spaced from the front face plate means and beyond the circumferential cylinder flange when the plug is in the cylinder;

a plurality of combinated tumblers in the tumbler passage configured to engage both the first and second key means, each tumbler defining a dimension transverse to the longitudinal axis no greater than the passage diameter, biasing means for the tumblers in each passage, to bias the combinated tumblers beyond the plug diameter to engage the cylinder and prevent plug rotation, said tumblers being translated agaist the force of the biasing means by either the first key means or the second key means to align the tumblers within the diameter of the plug whereby the plug may be rotated;

a control tumbler disc in the control tumbler passage configured to engage both the first and second key means, said control tumbler disc defining a transverse dimension greater than the cylinder passage diameter, said control tumbler disc defining unbiased means engaging the flange and preventing movement of the plug in a longitudinal direction out of the cylinder (1) during rotation of the plug when the first key means is placed in key slot and engages the control tumbler; and (2) during nonrotation of the plug when no key means is in the key slot, said control tumbler disc also defining unbiased means disengageable from the flange to release the plug when the second key means is engaged with all the tumblers to align the combinated tumblers within the diameter of the plug and the control tumbler disc is translated to extend one end into the longitudinal groove, said one end shaped to slide in the longitudinal groove, the opposite end being oversized relative to the groove.

2. The lock of claim 1 wherein each combinating tumbler and the control tumbler are disc members each having a longitudinal slot therethrough, one edge of the slot of each combinating tumbler cooperative with biting of the first key means and the second key means to align the tumblers for plug rotation, and one edge of the slot of the control tumbler cooperative with the first key means to position the control tumbler to prevent longitudinal removal of the plug, and the other edge of the control tumbler slot cooperative with the second key means to align the control tumbler for movement in the longitudinal groove in the cylinder.

3. The lock of claim 1 wherein the longitudinal groove in the cylinder has a transverse dimension defining the width of the groove and wherein the control tumbler has an opposite end with a transverse dimension greater than the transverse dimension of the longitudinal groove.

* * * * *